US006995725B1

(12) United States Patent
Honda et al.

(10) Patent No.: US 6,995,725 B1
(45) Date of Patent: Feb. 7, 2006

(54) ANTENNA ASSEMBLY

(75) Inventors: Royden M. Honda, Spokane, WA (US); W. Jim Savage, Veradale, WA (US); Marcus da Silva, Spokane, WA (US)

(73) Assignee: Vivato, Inc., San Francisco, CA (US)

( * ) Notice: Subject to any disclaimer, the term of this patent is extended or adjusted under 35 U.S.C. 154(b) by 0 days.

(21) Appl. No.: 10/658,346

(22) Filed: Sep. 9, 2003

Related U.S. Application Data

(60) Provisional application No. 60/423,700, filed on Nov. 4, 2002.

(51) Int. Cl.
*H01Q 13/10* (2006.01)

(52) U.S. Cl. ..... 343/771; 343/770; 343/767

(58) Field of Classification Search ..... 343/771, 343/770, 767, 785, 762; 333/208, 248, 239
See application file for complete search history.

(56) References Cited

U.S. PATENT DOCUMENTS 4,864,314 A * 9/1989 Bond ..... 343/700 MS
5,382,931 A * 1/1995 Piloto et al. ..... 333/208
5,416,492 A * 5/1995 Takahashi et al. ..... 343/771
5,596,338 A * 1/1997 Smith ..... 343/786
5,757,329 A * 5/1998 Hoover et al. ..... 343/770
6,094,106 A * 7/2000 Kishino et al. ..... 333/22 R

OTHER PUBLICATIONS

Kisliuk, M. and Axelrod, A., "Theoretical and Experimental Study of a Novel H-Guide Transverse Slot Antenna," IEEE Transactions on Microwave Theory and Techniques, vol. MTT-33, No. 5, May 1985, pp. 428-433.
Kisliuk, M. and Axelrod, A, "Design Feature, H-guide slot antenna shrinks sidelobes," Microwaves & RF, Jun. 1986, pp. 107-110.

* cited by examiner

*Primary Examiner*—Trinh Vo Dinh
(74) *Attorney, Agent, or Firm*—Lee & Hayes, PLLC

(57) ABSTRACT

In an implementation of antenna assembly, an antenna element is formed with a front plate that has slots for wireless communication signal transfer, a dielectric material, a channel guide that is designed to confine the dielectric in a position that aligns the dielectric with the slots in the front plate, and a back plate. The front plate, channel guide, and back plate are attached together to enclose the dielectric within the channel guide to form an enclosed dielectric channel. An antenna assembly includes one or more of the antenna elements.

31 Claims, 7 Drawing Sheets

ANTENNA ASSEMBLY

RELATED APPLICATION

This application claims the benefit of a related U.S. Provisional Application Ser. No. 60/423,700, filed Nov. 4, 2002, entitled "Antenna Assembly", to Honda et al., which is incorporated by reference herein.

TECHNICAL FIELD

This invention relates to antenna technology and, in particular, to an antenna assembly that can be implemented in a wireless data communications system.

BACKGROUND

Computing devices and other similar devices implemented to send and/or receive data can be interconnected in a wired network or a wireless network to allow the data to be communicated between the devices. Wired networks, such as wide area networks (WANs) and local area networks (LANs) for example, tend to have a high bandwidth and can therefore be configured to communicate digital data at high data rates. One obvious drawback to wired networks is that the range of movement of a device is constrained since the device needs to be physically connected to the network for data exchange. For example, a user of a portable computing device will need to remain near to a wired network junction to maintain a connection to the wired network.

An alternative to wired networks is a wireless network that is configured to support similar data communications but in a more accommodating manner. For example, the user of the portable computing device can move around within a region that is supported by the wireless network without having to be physically connected to the network. A limitation of conventional wireless networks, however, is their relatively low bandwidth which results in a much slower exchange of data than a wired network. Wireless networks will become more popular as data exchange rates are improved and as coverage areas supported by a wireless network are expanded.

Rectangular waveguides can be implemented in data transmission systems as antennas and as low loss transmission lines to communicate data from one device to another in the form of a propagated electromagnetic field. A rectangular waveguide has a cutoff frequency (or wavelength) that is determined by the physical size of the device. The width of the waveguide determines the cutoff frequency ($\lambda_{co}$) which can be represented by $\lambda_{co}$=2a, where "a" is the width of the waveguide. Any frequency above the cutoff frequency is propagated. Typically, the recommended operating frequency range of a rectangular waveguide is approximately twenty-five percent (25%) above the cutoff frequency and five percent (5%) below the frequency where $\lambda$=a. Operating above this frequency is undesirable because higher order modes can occur which interfere with the fundamental mode causing signal distortion and increased signal attenuation.

An additional property related to the cutoff wavelength $\lambda_{co}$ of the waveguide is the guide wavelength $\lambda_g$ which is the wavelength as determined within the waveguide. The guide wavelength $\lambda_g$ is related to the cutoff wavelength $\lambda_{co}$ by the equation:

$$\lambda_g^2 = \lambda^2 / 1 - (\lambda / \lambda_{co})^2$$

As the operating wavelength $\lambda$ approaches the cutoff frequency $\lambda_{co}$, the guide wavelength $\lambda_g$ gets larger (the guide wavelength $\lambda_g$ is always larger than the operating wavelength $\lambda$).

A rectangular waveguide that is implemented as an antenna element can be formed with slots in a wall of the waveguide for electromagnetic signal transmission. The slots are typically spaced $\lambda_g/2$ apart in the antenna element wall. To keep the slot spacing operating frequency reasonably close to that of free space (i.e., $\lambda/2$), and to keep the length of the antenna element as short as possible, the operating frequency $\lambda$ must be well above the cutoff frequency $\lambda_{co}$. It is difficult to design and construct a rectangular waveguide as an antenna element that can be combined with multiple antenna elements to form an antenna array that is small enough to be physically manageable while having a useful operating frequency. Further, for an array of slotted waveguide antenna elements that are positioned together to form the antenna array, the ideal spacing of $\lambda/2$ between waveguide antenna element centers is not achievable.

SUMMARY

An antenna assembly is described herein.

In an implementation, an antenna element is formed with a front plate that has slots for wireless communication signal transfer, a dielectric material, a channel guide that is designed to confine the dielectric in a position that aligns the dielectric with the slots in the front plate, and a back plate. The front plate, channel guide, and back plate are attached together to enclose the dielectric within the channel guide to form an enclosed dielectric channel. An antenna assembly includes one or more of the antenna elements.

BRIEF DESCRIPTION OF THE DRAWINGS

The same numbers are used throughout the drawings to reference like features and components.

DETAILED DESCRIPTION

A wireless communication system is described that includes at least one wireless routing device that is configured to communicate over a wireless communication link via an antenna assembly with at least one device implemented for communication within the wireless system. The wireless communication system can be implemented to communicate with multiple devices, such as portable computers, computing devices, and any other type of electronic and/or communication device that can be configured for wireless communication. Further, the multiple devices can be configured to communicate with one another within the wireless communication system. The wireless communication system can be implemented as a wireless local area network (WLAN), a wireless wide area network (WAN), a wireless metropolitan area network (MAN), or other similar wireless network configurations.

The following discussion is directed to an exemplary antenna assembly for a wireless communication system. The antenna assembly is a very thin, high efficiency antenna array which is cost effective to manufacture and which can be implemented for wireless data communications. The antenna assembly can be manufactured less than one-quarter of an inch thick and element components of the antenna assembly can be stamped out of commonly available sheet metal. Further, the antenna assembly does not use expensive radio frequency (RF) connectors to couple transmission signal conductors to receive RF signals that excite the electromagnetic wave(s) in the antenna elements. Rather, a connector-less RF junction is implemented that utilizes standard rivets or any other type of mechanical connection.

The antenna assembly can be implemented as part of an antenna system that is an unobtrusive indoor or outdoor Wi-Fi (wireless fidelity) antenna panel that includes various operability components such as RF devices and components, a central processing unit, a power supply, and other logic components. The antenna system is a lightweight and thin structure that can be mounted on a wall or in a corner of a room to provide wireless communications over a broad coverage area, such as throughout a building and surrounding area, or over an expanded region, such as a college campus or an entire corporate or manufacturing complex. While the antenna assembly may be applicable or adaptable for use in other communication systems, the antenna assembly is described in the context of the following exemplary environment.

Figure 1:
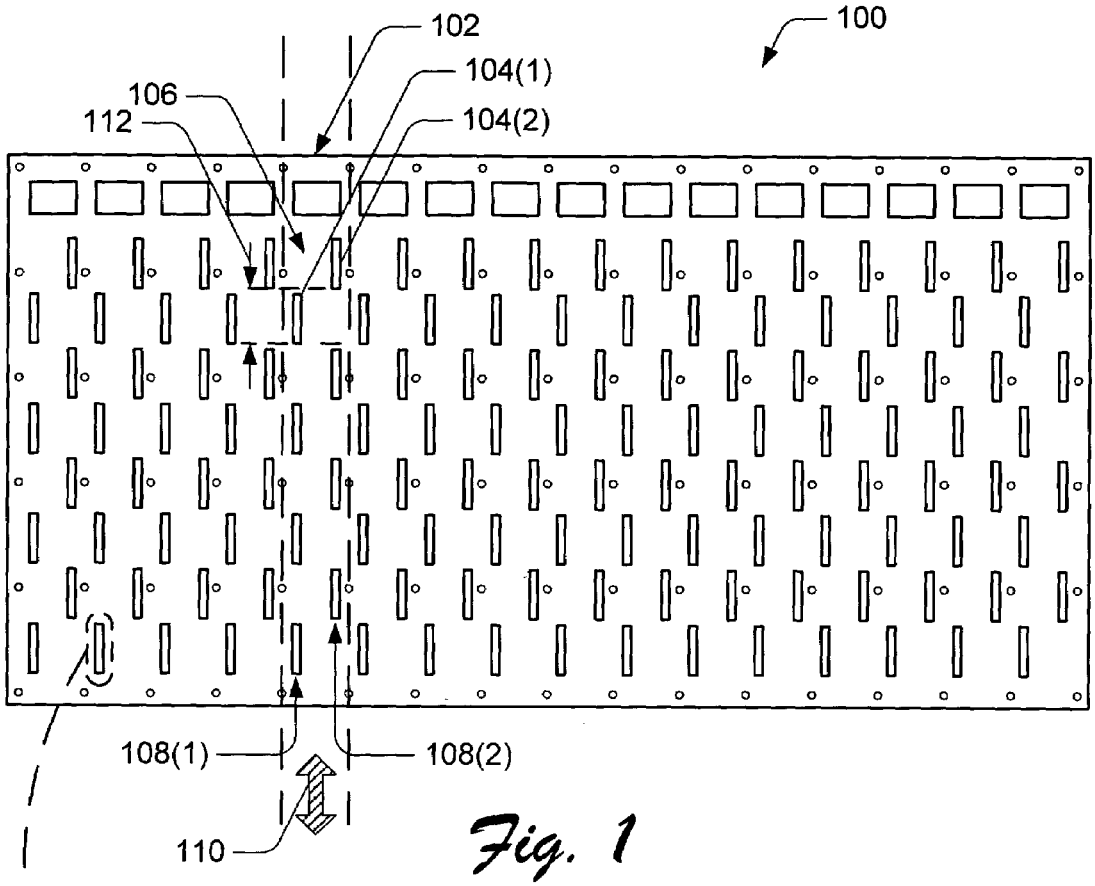
FIG. 1 illustrates an exemplary antenna assembly.

FIG. 1 illustrates an exemplary antenna assembly 100 that is formed with an array of antenna elements 102. Each antenna element 102 has multiple communication signal transfer slots 104 that are formed into a front surface 106 of the antenna element 102. The antenna assembly 100 transmits and receives data as electromagnetic communication signals via the transfer slots 104 in each antenna element 102.

The communication signal transfer slots 104 in an antenna element 102 are formed into two parallel slot rows 108(1) and 108(2) in which the slots 104(1) in slot row 108(1) are staggered, or otherwise offset, in relation to the slots 104(2) in slot row 108(2). Each slot 104(1) in slot row 108(1) is offset from each slot 104(2) in slot row 108(2) in a direction 110 and a distance 112. For example, slot 104(1) in row 108(1) is offset from slot 104(2) in row 108(2) in a direction that is parallel to the slot rows 108 (e.g., the direction 110) over a distance that is approximately the length of one rectangular slot 104 (e.g., the distance 112). The distance 112 between slots 104 in a slot row 108 is approximately the antenna element wavelength $\lambda_g/2$ apart.

In this example, the antenna assembly 100 is shown configured for indoor use with sixteen antenna elements (e.g., sixteen of antenna element 102 formed or otherwise positioned together) each having two parallel rows of four slots each (e.g., slot rows 108(1) and 108(2)). The antenna assembly 100 can be configured for outdoor use with thirty-two antenna elements (e.g., multiple antenna elements 102) each having two parallel rows of eight slots each, or can be configured as a larger antenna with more antenna elements having more slots per slot row. The antenna assembly 100 can be configured with as many antenna elements having any number of slots per slot row as needed to provide communication signal transfer over a region or desired coverage area.

Figure 2:
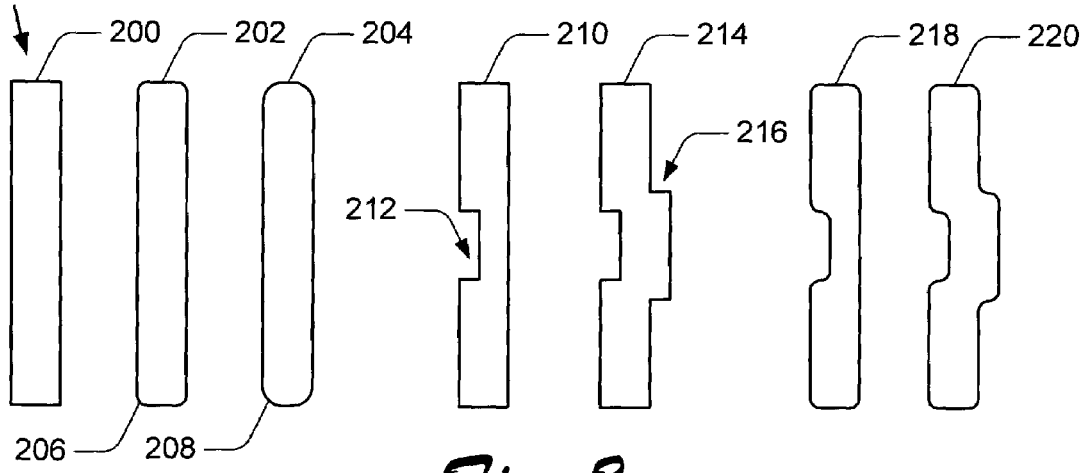
FIG. 2 illustrates various examples of antenna element slots that can be formed within an antenna element of the exemplary antenna assembly shown in FIG. 1.

FIG. 2 illustrates various examples of communication signal transfer slots that can be formed into an antenna element 102 (FIG. 1) to transmit and/or receive electromagnetic communication signals. The slots in an antenna element can be rectangular 200, or can be formed as substantially rectangular slots 202 and 204 with rounded corners 206 and 208, respectively. Any radius, or arc length, can be used to form the rounded corners of a rectangular slot. For example, the corners 208 of rectangular slot 204 have a larger radius dimension and arc length than the corners 206 of rectangular slot 202.

An antenna element slot for communication signal transfer can also be formed as a notched slot 210 having a notch 212 formed into one side of the slot, or can be formed as an offset slot 214 having an offset section 216. The offset section 216 can be formed about a transverse center of the offset slot 214 (as shown), or can be formed off-center of the offset slot 214. Further, a notched slot (e.g., 210) and an offset slot (e.g., 214) can be formed with rounded corners, such as rounded-corner notched slot 218 and rounded-corner offset slot 220.

The offset slot 214 is implemented with the offset section 216 to control the impedance of the communication signal transfer slot and to further enhance the impedance matching of the antenna assembly 100. Further, implementing the antenna assembly 100 with offset slots (e.g., offset slot 214) increases the broadband characteristics of the antenna assembly 100 which allows more communication signals to be transmitted in a given time duration.

Figure 3:
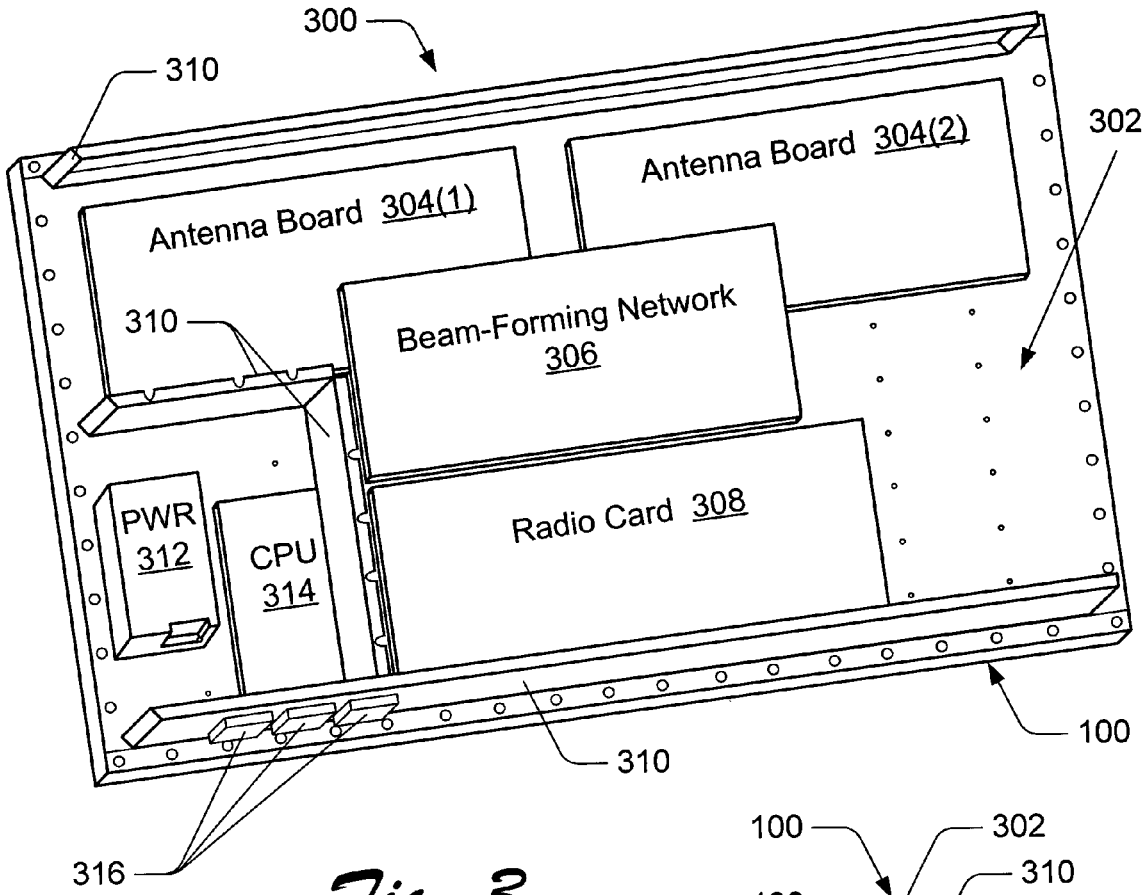
FIG. 3 illustrates various components of an exemplary antenna system in which the exemplary antenna assembly shown in FIG. 1 can be implemented.

FIG. 3 illustrates various components of an exemplary antenna system 300 that includes the exemplary antenna assembly 100 (FIG. 1) which is shown from a back-view perspective having a back surface 302 (FIG. 1 illustrates a front-view of the antenna assembly 100). The antenna system 300 includes antenna boards 304(1) and 304(2), a beam-forming network 306, and a radio card 308 that are each coupled to, or directly affixed to, the back surface 302 of the antenna assembly and/or to framework structures 310. The antenna system 300 also includes a power supply 312, a central processing unit 314, one or more communication interfaces 316, and may include any number of other circuit and/or logic components.

As used herein, the term "logic" refers to hardware, firmware, software, or any combination thereof that may be implemented to perform the logical operations associated with a particular function or with the operability of the antenna system 300. Logic may also include any supporting circuitry that is utilized to complete a given task including supportive non-logical operations. For example, logic may also include analog circuitry, memory components, input/ output (I/O) circuitry, interface circuitry, power providing/regulating circuitry, microstrip transmission lines, and the like.

The radio card 308 processes digital information to generate an RF communication signal for electromagnetic transmission, and processes an RF communication signal to generate digital information when the antenna assembly 100 receives the RF communication signal. The beam-forming network 306 configures the phasing of antenna system 300, receives RF communication signals from the radio card 308, and communicates the RF communication signals to the antenna boards 304(1) and 304(2). The antenna boards 304(1) and 304(2) each include one or more transmitters that are power amplifiers for transmitting communication signals and one or more receivers that are low noise amplifiers for receiving communication signals via the antenna assembly 100.

The power supply 312 can be a wired or a self-contained power supply that provides power to operate the various components of the antenna system 300. The central processing unit 314 can be implemented as one or more processors, microprocessors, or as any other type of controller that processes various computer-executable instructions to interface and control the operation of the various components of the antenna system 300.

Each of the communication interfaces 316 can be implemented as any one of a serial, parallel, network, or wireless interface that communicatively couples the antenna system 300 with other electronic or computing devices. For example, the antenna system 300 can be coupled with a wired connection (e.g., an input/output cable) via a communication interface 316 to a network switch that communicates digital information corresponding to a communication signal to a server computing device. Any of the communication interfaces 316 can also be implemented as an input/output connector to couple digital, universal serial bus (USB), local area network (LAN), wide area network (WAN), metropolitan area network (MAN), and similar types of information and communication connections.

Figure 4:
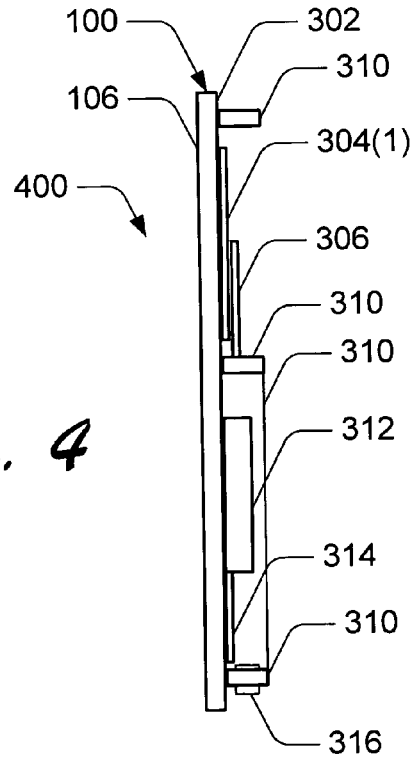
FIG. 4 illustrates a side-view of the exemplary antenna system shown in FIG. 3.

FIG. 4 illustrates a side-view 400 of the exemplary antenna system 300 shown in FIG. 3. The antenna system 300 is narrow in depth and can be mounted on a wall, such as on an interior building wall, between a corner of two perpendicular interior building walls, or on an exterior building wall for wireless communication signal transfer over a designated region. The antenna system 300 can be implemented as part of a Wi-Fi (wireless fidelity) system that includes any type of 802.11 network, such as 802.11b, 802.11a, dual-band, or as any other communications system.

Figure 5:
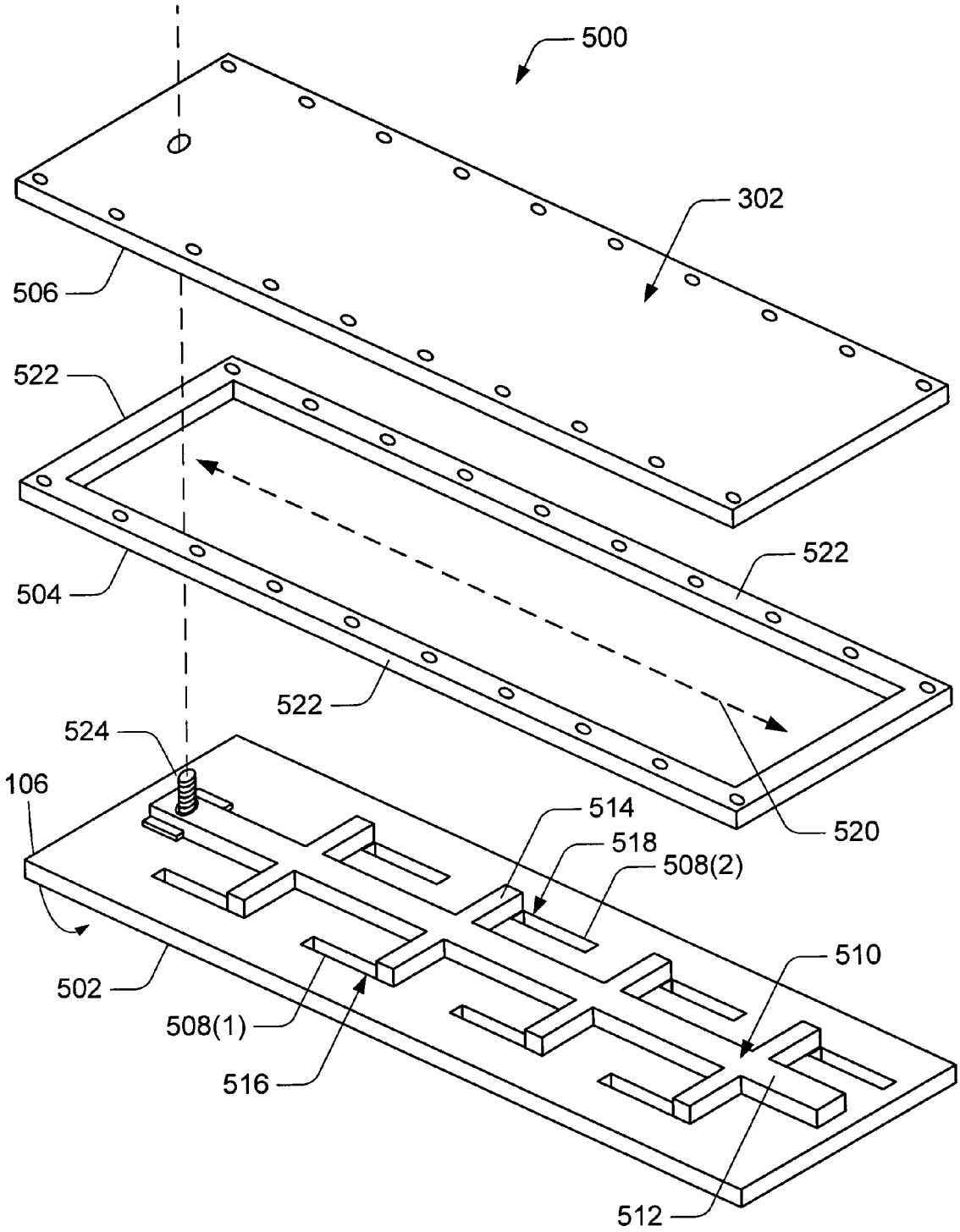
FIG. 5 illustrates various components of an exemplary antenna element.

FIG. 5 illustrates various components of an exemplary antenna element 500. Multiple antenna elements, such as antenna element 500, are positioned, or otherwise manufactured together, to form the exemplary antenna assembly 100 shown in FIG. 1 (an individual antenna element is identified as item 102 in FIG. 1). The antenna element 500 includes a front plate 502, a channel guide 504, and a back plate 506. With respect to the illustrated perspective of antenna assembly 100 shown in FIG. 1, the front surface 106 of an antenna element (e.g., antenna elements 102 and 500) is the underside of the front plate 502 as positioned in FIG. 5. With respect to the illustrated perspective of antenna system 300 shown in FIG. 3, the back surface 302 of an antenna element (e.g., antenna elements 102 and 500) in the antenna system 300 is the topside of back plate 506 as positioned in FIG. 5.

The front plate 502, channel guide 504, and back plate 506 can all be stamped out of commonly available sheet metal plates to minimize the manufacturing costs of an antenna system 300 (e.g., no special materials or material sizes are required to construct an antenna element 500, or to manufacture the antenna assembly 100). In this example, the front plate 502 is stamped out of 0.050" sheet metal, the channel guide 504 is stamped out of 0.125" sheet metal, and the back plate 506 is stamped out of 0.062" sheet metal.

The front plate 502 includes multiple communication signal transfer slots 508 which are laid out into two parallel rows of slots as described above with reference to slot rows 108(1) and 108(2) as shown in FIG. 1. The multiple slots 508 can be formed as any one of the exemplary slots shown in FIG. 2, or as any other type of slot having any shape.

The antenna element 500 includes a dielectric 510 that is formed with a center conductive section 512 and with multiple cross-sections 514 that are positioned transverse, or perpendicular, to the center conductive section 512 and spaced to align with the offsetting slots 508. The center conductive section 512 is positioned between the two slot rows and can extend nearly the length of the antenna element 500. Cross-section 514 is perpendicular to the center conductive section 512 and is spaced between offsetting slots 508(1) and 508(2). The cross-section 514 is illustrated in FIG. 5 to extend to an outer edge 516 of slot 508(1) and to extend to an outer edge 518 of slot 508(2). The multiple cross-sections (e.g., cross-section 514) can also span a length that is shorter than the distance from the outer edge 516 of slot 508(1) to the outer edge 518 of slot 508(2), or the multiple cross-sections 514 can span a length that is longer.

The dielectric 510 can be formed from high impact polystyrene (HIPS), rexolite which is a cross-linked polystyrene, or from any other type of dielectric material having similar properties to support an electrostatic field to implement the antenna element 500. Other dielectric materials can include ceramic, mica, glass, and plastic materials, as well as various metal oxides.

The dielectric 510 confines an electric field within an enclosed dielectric channel 520 that is formed when the front plate 502, channel guide 504, and back plate 506 are all positioned and attached together. This structure forms a solid dielectric enclosed within a waveguide. The width of the dielectric 510 (e.g., the average calculated width) controls the concentration of energy which results in an electric field that is confined within the enclosed dielectric channel 520 such that the antenna element wavelength will be very near to that of free space. The average width of the dielectric 510, as determined by the width of the center conductive section 512 with the multiple cross-sections 514, makes the enclosed dielectric channel 520 seem much wider than it actually is which results in the element wavelength being near to that of free space.

The dielectric 510 controls, or otherwise regulates, the cutoff frequency (e.g., cutoff wavelength) of the antenna element 500. The shape of the dielectric 510, as formed by the center conductive section 512 and the multiple cross-sections 514, is configured to achieve a proper phase relationship between the communication signal transfer slots 508 and the coupling coefficients of the slots 508 for the given length and width of the enclosed dielectric channel 520 formed when the front plate 502, channel guide 504, and back plate 506 are all positioned and attached together.

The channel guide 504 confines the dielectric 510 within the enclosed dielectric channel 520 to align the dielectric cross-sections 514 with the slots 508. Additionally, sidewalls 522 of the channel guide 504 prevent communication interference, or "cross-talk", between adjacent and nearby antenna elements formed into an antenna assembly 100 (FIG. 1). A fastener component, such as a connection bolt 524 mechanically couples the dielectric 510 into the enclosed dielectric channel 520. Although only one exemplary dielectric 510 is shown in FIG. 5, the shape of the center conductive portion 512 and/or the shape of the cross-sections 514 can be modified and further configured to any shape and design that achieves a desired phase relationship for the antenna element 500 and for the antenna assembly 100.

Figure 6:
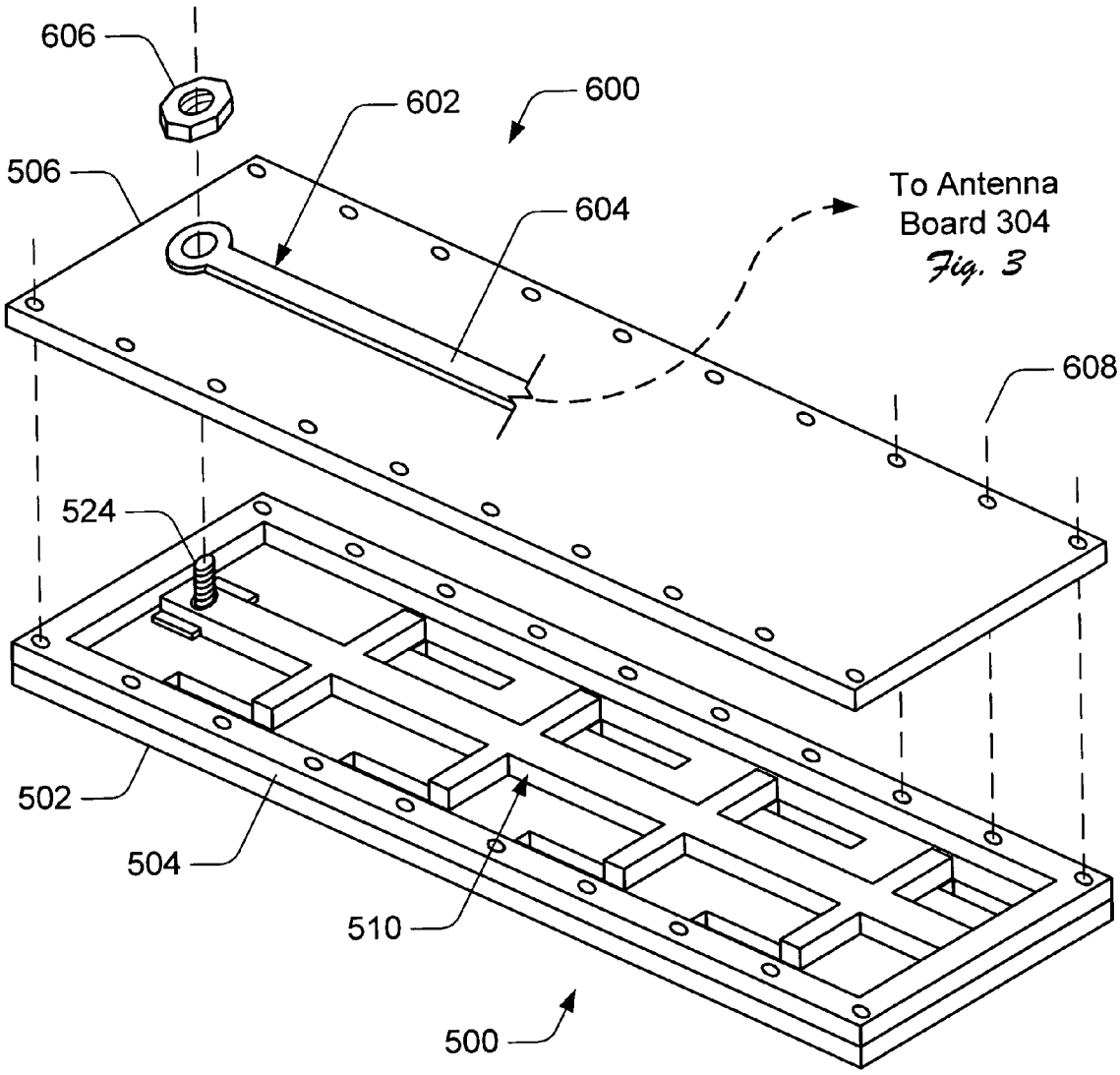
FIG. 6 illustrates the various components of the exemplary antenna element shown in FIG. 5 and an exemplary connection system that can be implemented to couple the antenna element to components of the exemplary antenna system shown in FIG. 3.

FIG. 6 illustrates the various components of the exemplary antenna element 500 shown in FIG. 5 and an exemplary connection system 600 that can be implemented to couple the antenna element 500 to components of the antenna system 300 shown in FIG. 3. The connection system 600 includes a microstrip connector 602 that has a conductive trace 604 which communicatively couples the antenna element 500 to an antenna board 304 of the antenna system 300.

The connection system 600 is positioned on the antenna element back plate 506 and is coupled to the dielectric 510 with the connection bolt 524 and an associated connection bolt nut 606, or with any other type of fastener or fastener components, such as a rivet connection. The front plate 502, channel guide 504, and back plate 506 of the antenna element 500 can also be attached together with rivets or similar fasteners at each attachment point 608 along the outer edges of the front plate 502, channel guide 504, and back plate 506.

Figure 7:
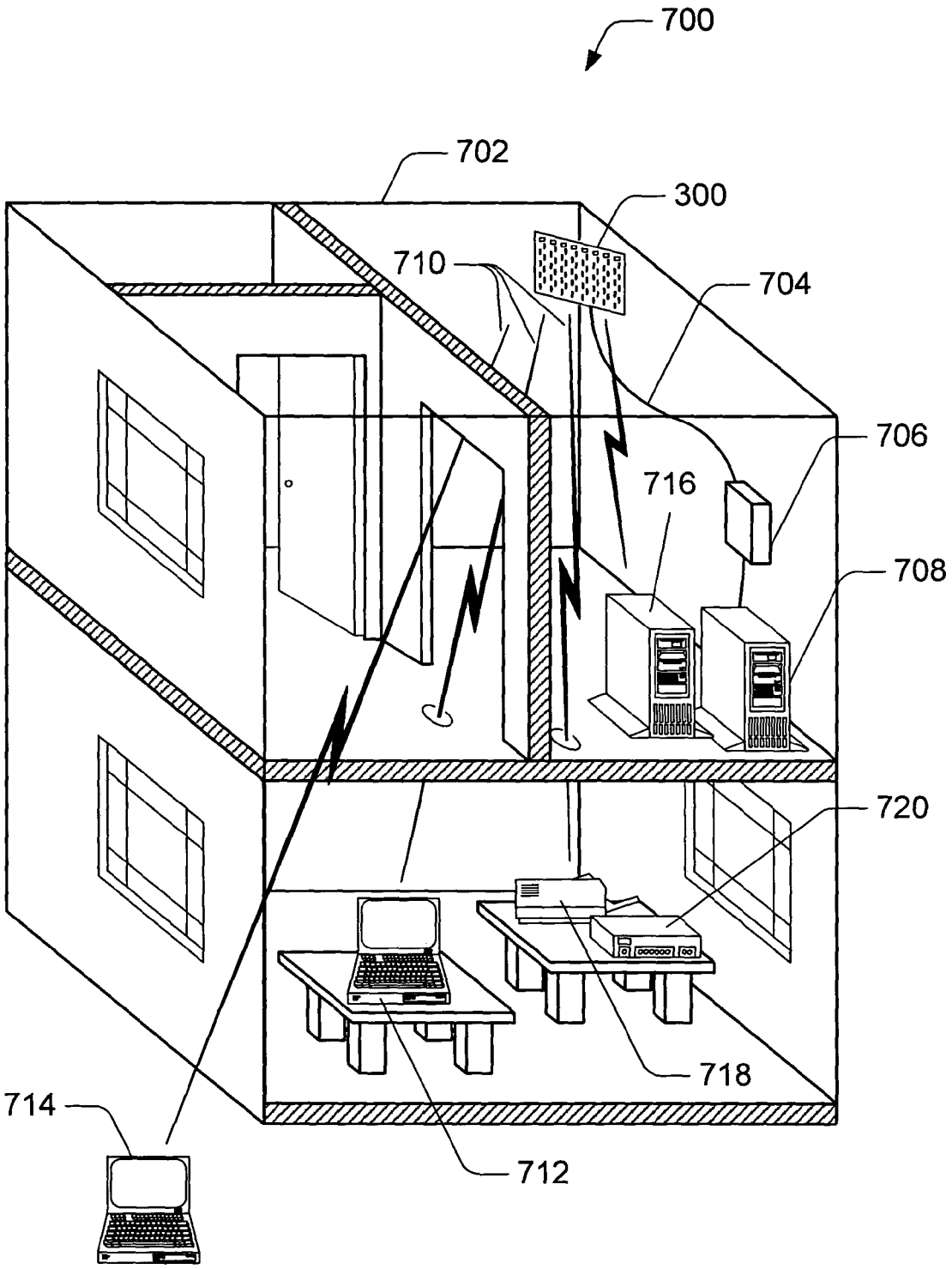
FIG. 7 illustrates an exemplary wireless communication system that includes an exemplary antenna system.

FIG. 7 illustrates an exemplary wireless communication system 700 that includes the exemplary antenna system 300 shown in FIG. 3 (which includes the antenna assembly 100 shown in FIG. 1). In this example, the antenna system 300 is positioned inside of a building 702 and mounted in a corner between two interior perpendicular walls to provide wireless communications throughout the building 702 and throughout a region outside of the building 702. The antenna system 300 has a greater than ninety degree transmission pattern which exceeds the ninety degree corner placement of the antenna system 300 to provide complete coverage within the building 702. Additionally, the antenna system 300 can have a decorative and/or protective cover or enclosure (not shown) to conceal and protect the antenna from damage.

The antenna system 300 has a wired connection 704 (e.g., an input/output communication cable) to a local area network (LAN) switch 706 which is itself wired to a server computing device 708. The server computing device 708 can be positioned locally within building 702, or at a remote location, to administrate and control the associated functions and operations of the wireless communication system 700. The antenna system 300 is implemented to wirelessly communicate information and data received via the LAN connection 706 from the server computing device 708 to any number of electronic and computing devices that are client devices configured to recognize and receive transmission signals 710 transmitted from the antenna system 300. Such electronic and computing devices include desktop and portable computing devices that are configured with a wireless communication card, such as computing devices 712, 714, and 716, a printing device 718, and any other type of electronic device 720 to include a personal digital assistant (PDA), cellular phone, and similar mobile communication devices, or devices that can be configured for wireless communication connectivity. Some of the electronic and computing devices may also be connected together via a wired network and/or communication link.

Figure 8:
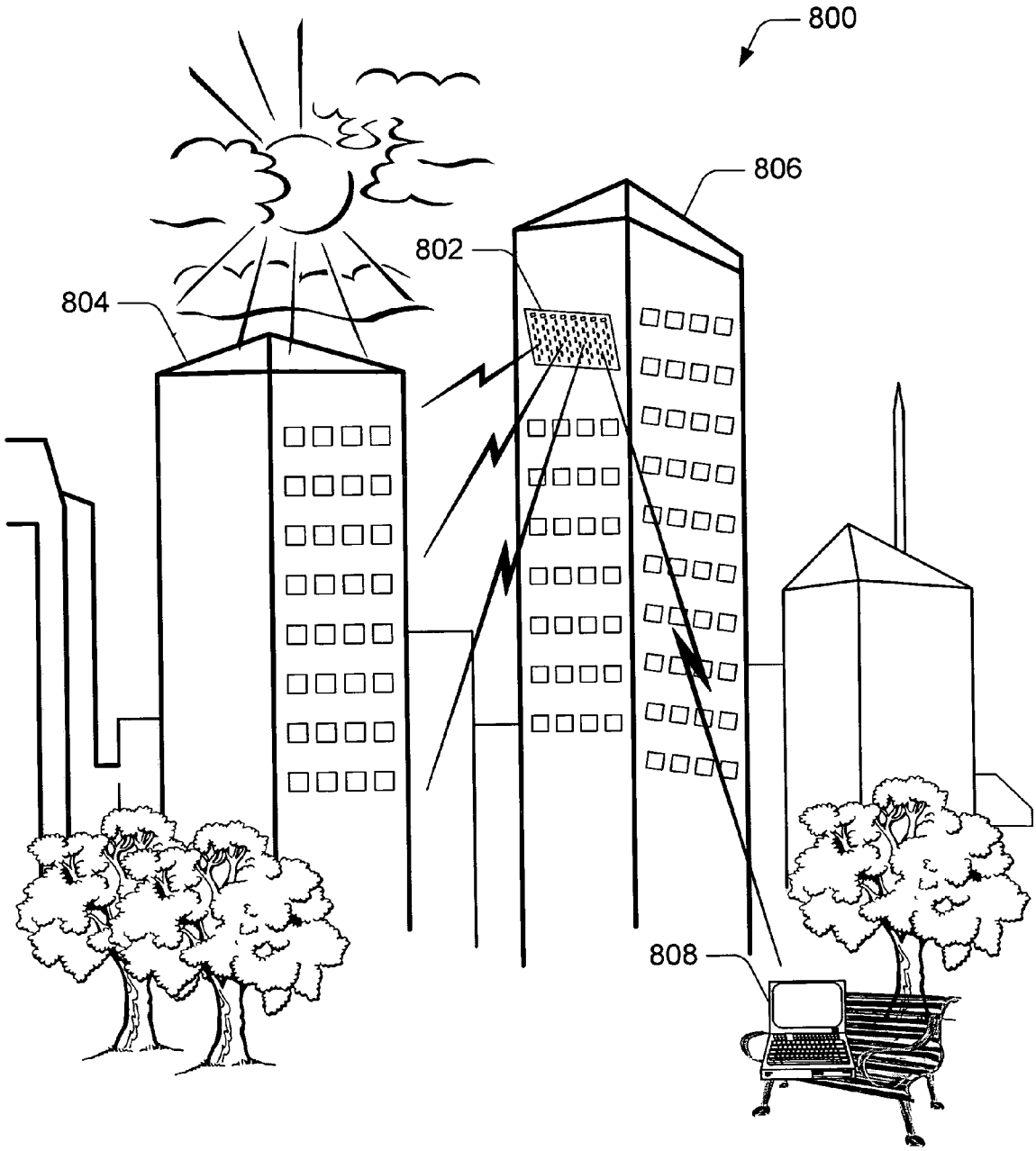
FIG. 8 illustrates an exemplary wireless communication system that includes an exemplary antenna system.

FIG. 8 illustrates an exemplary wireless communication system 800 that includes an antenna system 802 which is similar to antenna system 300 shown in FIG. 3, but larger in size for an outdoor application. In this example, the antenna system 802 is positioned outside of a building 804 and mounted on an adjacent building 806 to provide wireless communications throughout building 804 and throughout a region outside of building 804. The antenna system 802 can have a decorative and/or weatherproof protective cover or enclosure (not shown) to conceal and protect the antenna from natural and other elements.

The antenna system 802 can be wired via a LAN connection, for example, to a server computing device positioned in building 806 that administrates and controls the associated functions and operations of the wireless communication system 800. The antenna system 802 can be implemented to wirelessly communicate information and data received via the LAN connection to any number of electronic and computing devices that are client devices configured to recognize and receive transmission signals from the antenna system 802. Such electronic and computing devices include desktop and portable computing devices, printing devices, and any other type of electronic devices configured for wireless communication connectivity throughout building 804, as well as portable devices outside of building 804, such as computing device 808.

Figure 9:
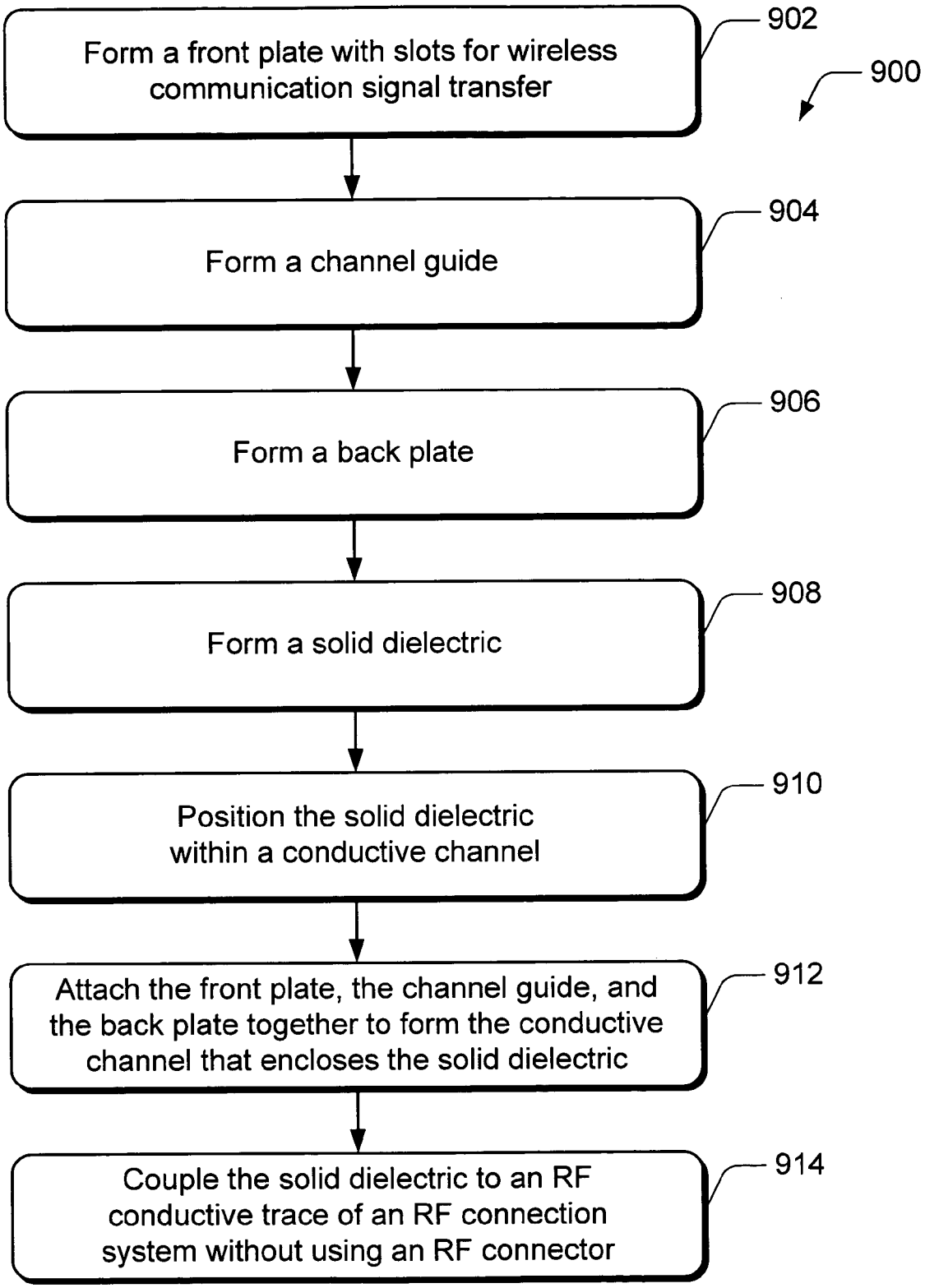
FIG. 9 is a flow diagram of an exemplary method for an antenna assembly.

FIG. 9 illustrates a method 900 for an antenna assembly. The order in which the method is described is not intended to be construed as a limitation, and any number of the described method blocks can be combined in any order to implement the method.

At block 902, a front plate is formed with slots for wireless communication signal transfer. For example, a front plate 502 (FIG. 5) of an antenna element 500 has communication signal transfer slots 508 that transmit and receive data as electromagnetic communication signals. The front plate 502 can be formed with a first row 108(1) of one or more slots 104(1) and a second row 108(2) of one or more slots 104(2), and the slots 104(1) in the first row 108(1) are offset from the slots 104(2) in the second row 108(2). The slots can be formed rectangular, such as slot 200 (FIG. 2), or substantially rectangular, such as slots 202 and 204. Further, the slots can be formed as offset slots, such as offset slot 214 that has an offset section 216 formed about a transverse center of the offset slot 214.

At block 904, a channel guide is formed. For example, channel guide 504 (FIGS. 5 and 6) can be formed with first and second sidewalls 522 that prevent communication signal interference with an adjacent conductive channel. At block 906, a back plate is formed. For example, back plate 506 (FIGS. 5 and 6) is formed.

At block 908, a solid dielectric is formed. For example, dielectric 510 (FIG. 5) is designed to regulate a cutoff wavelength of the conductive channel 520 that is formed when the front plate 502, channel guide 504, and back plate 506 are attached together. The dielectric 510 is formed with a center conductive section 512 and with one or more cross-sections 514 that are transverse, or perpendicular, to the center conductive section 512.

At block 910, the solid dielectric is positioned within a conductive channel. For example, dielectric 510 (FIG. 5) is positioned such that the center conductive section 512 extends lengthwise within the conductive channel 520 and such that the one or more cross-sections 514 are spaced to align with the slots 508 in the front plate 502. At block 912, the front plate, the channel guide, and the back plate are attached together to form the conductive channel that encloses the solid dielectric. For example, dielectric 510 is enclosed in the dielectric channel 520 when the front plate 502, channel guide 504, and back plate 506 are attached together (as shown in FIG. 6).

At block 914, the solid dielectric is coupled to an RF conductive trace of an RF connection system without using an RF connector. For example, dielectric 510 is coupled to microstrip conductive trace 604 (FIG. 6) of a microstrip connector 602 with fastener components (e.g., connection bolt 524 and connection nut 606, or a similar fastener.

Although antenna assembly has been described in language specific to structural features and/or methods, it is to be understood that the subject of the appended claims is not necessarily limited to the specific features or methods described. Rather, the specific features and methods are disclosed as exemplary implementations of antenna assembly.

What is claimed is:

1. An antenna element, comprising:

a front plate that includes slots configured for wireless communication signal transfer;

a dielectric configured to regulate a cutoff wavelength of the antenna element;

a channel guide coupled to the front plate and configured to confine the dielectric in a position that aligns the dielectric with the slots in the front plate, the channel guide including a first sidewall and a second sidewall that are each configured to prevent communication signal interference between the antenna element and an adjacent antenna element; and a back plate coupled to the channel guide and configured to enclose the dielectric within the channel guide to form an enclosed dielectric channel.

2. An antenna element as recited in claim 1, wherein the dielectric is formed from a polystyrene material.

3. An antenna element as recited in claim 1, wherein the dielectric includes a center conductive section and one or more cross-sections.

4. An antenna element as recited in claim 1, wherein the dielectric includes a center conductive section and one or more cross-sections transverse to the center conductive section.

5. An antenna element as recited in claim 1, wherein:

the dielectric includes a center conductive section and one or more cross-sections perpendicular to the center conductive section;

the center conductive section extends lengthwise within the enclosed dielectric channel; and the one or more cross-sections are spaced within the enclosed dielectric channel to align with the slots in the front plate.

6. An antenna element as recited in claim 1, wherein:

the dielectric includes a center conductive section and one or more cross-sections perpendicular to the center conductive section;

the center conductive section extends lengthwise within the enclosed dielectric channel between a first row of the slots and a second row of the slots; and the one or more cross-sections are spaced within the enclosed dielectric channel to align with the slots in the front plate.

7. An antenna element as recited in claim 1, wherein at least one of the first sidewall or the second sidewall is a common sidewall of the antenna element and the adjacent antenna element.

8. An antenna element as recited in claim 1, wherein the front plate further includes the slots spaced apart a distance that is substantially equivalent to an antenna element wavelength divided by two.

9. An antenna element as recited in claim 1, wherein the front plate further includes a first row of one or more of the slots and a second row of one or more of the slots.

10. An antenna element as recited in claim 1, wherein the front plate further includes a first row of one or more of the slots and a second row 1 of one or more of the slots, and wherein the slots in each of the first row and the second row are spaced apart a distance that is substantially equivalent to an antenna element wavelength divided by two.

11. An antenna element as recited in claim 1, wherein the front plate fixer includes a first row of one or more of the slots and a second row of one or more of the slots, and wherein the slots in the first row are offset from the slots in the second row.

12. An antenna element as recited in claim 1, wherein;

the front plate further includes a first row of one or more of the slots and a second row of one or more of the slots; and the slots in the first row are offset from the slots in the second row in a direction parallel to the first row and a distance that is substantially a length of a slot.

13. An antenna element as recited in claim 1, wherein the slots in the front plate are substantially rectangular.

14. An antenna element as recited in claim 1, wherein the slots in the front plate are notched slots.

15. An antenna element as recited in claim 1, wherein the slots in the front plate are offset slots.

16. An antenna element as recited in claim 1, wherein the slots in the front plate are offset slots, and wherein an offset slot is substantially rectangular having an offset section formed about a transverse center of the offset slot.

17. An antenna element as recited in claim 1, further comprising a connection system configured to communicatively couple the antenna element to an antenna system component.

18. An antenna element as recited in claim 1, further comprising:

an RF connection system configured to communicatively couple the antenna element to an antenna system component; and a fastener component configured to communicatively couple the dielectric to the RF connection system without an RF connector.

19. An antenna assembly comprising one or more antenna elements as recited in claim 1.

20. A method, comprising:

forming a front plate of an antenna assembly with slots configured to wirelessly transfer communication signals;

forming a channel guide of an antenna element, the channel guide including at least a first sidewall and a second sidewall that are each configured to prevent communication signal interference between the antenna element and an adjacent antenna element;

forming a back plate of the antenna assembly; and attaching the front plate, the channel guide, and the back plate together to form the antenna element of the antenna assembly, the antenna element being formed as a conductive channel that encloses a solid dielectric.

21. A method as recited in claim 20, further comprising forming the solid dielectric to regulate a cutoff wavelength of the conductive channel.

22. A method as recited in claim 20, further comprising forming the solid dielectric with a center conductive section and one or more transverse cross-sections.

23. A method as recited in claim 20, further comprising forming the solid dielectric with a center conductive section and one or more cross-sections perpendicular to the center conductive section.

24. A method as recited in claim 20, further comprising:

forming the solid dielectric with a center conductive section and one or more cross-sections perpendicular to the center conductive section; and positioning the solid dielectric such that the center conductive section extends lengthwise within the conductive channel and the one or more cross-sections are spaced to align with the slots in the front plate.

25. A method as recited in claim 20, wherein forming the channel guide includes forming the channel guide of the antenna element such that at least one of the first sidewall or the second sidewall is a common sidewall of the antenna element and the adjacent antenna element.

26. A method as recited in claim 20, wherein forming the front plate includes forming the front plate with a first row of one or more of the slots and a second row of one or more of the slots.

27. A method as recited in claim 20, wherein forming the front plate includes forming the front plate with a first row of one or more of the slots and a second row of one or more of the slots, and wherein the slots in the first row are offset from the slots in the second row.

28. A method as recited in claim 20, wherein forming the front plate includes forming the front plate with the slots that are substantially rectangular.

29. A method as recited in claim 20, wherein forming the front plate includes forming the front plate with the slots that are offset slots.

30. A method as recited in claim 20, wherein forming the front plate includes forming the front plate with the slots that are offset slots, and wherein each offset slot has an offset section formed about a transverse center of the offset slot.

31. A method as recited in claim 20, further comprising coupling the solid dielectric to an RF conductive trace of an RF connection system without using an RF connector.

* * * * *